United States Patent [19]

Cohen et al.

[11] 4,106,591

[45] Aug. 15, 1978

[54] KNOCK-DOWN OPEN RISER STAIRWAY

[75] Inventors: Allen Cohen, Havertown; Howard Cohen; Ronald Cohen, both of Broomall, all of Pa.

[73] Assignee: M. Cohen & Sons, Inc., Broomall, Pa.

[21] Appl. No.: 787,089

[22] Filed: Apr. 13, 1977

[51] Int. Cl.[2] ..... E04F 11/12

[52] U.S. Cl. ..... 182/93; 182/100; 182/220; 182/228; 52/182

[58] Field of Search ..... 182/100, 189, 228, 194, 182/93; 52/182, 191; 248/226.3, 230

[56] References Cited

U.S. PATENT DOCUMENTS

| | | | |
|---|---|---|---|
| 2,759,695 | 8/1956 | Berner | 248/226.3 |
| 2,936,863 | 5/1960 | Holzer | 52/191 |
| 3,310,132 | 3/1967 | Rolland | 182/189 |
| 3,467,220 | 9/1969 | Smith | 52/182 |
| 3,834,098 | 9/1974 | Wutzke | 182/228 |
| 3,888,354 | 6/1975 | Margolin | 248/226.3 |

FOREIGN PATENT DOCUMENTS

| | | | |
|---|---|---|---|
| 634,786 | 2/1962 | Italy | 52/182 |

*Primary Examiner*—Reinaldo P. Machado

*Attorney, Agent, or Firm*—Howson & Howson

[57] ABSTRACT

A stairway capable of being shipped in a knock-down condition and erected with a minimum of labor and without special tools is disclosed. The stairway comprises a square tubular elongated support member having mounting brackets at each end enabling it to be mounted in inclined relation between different levels of a structure. A plurality of step assemblies are clamped in spaced relation onto the support member. Each step assembly includes a tread support having a horizontal load bearing portion and an angulated integral strut portion both fastened to a mounting flange which engages the topside of the support member. A locking sleeve surrounds the bottom and side walls of the support member and has outturned flanges which are fastened to the mounting plate by bolts. In one embodiment, the bottom of the locking sleeve has a slight upward convexity which flexes elastically when the bolts are tightened to maintain clamping pressure against the support member. In another embodiment the bottom of the locking sleeve engages flush against the bottom of the support member and the locking sleeve flanges are spaced from the mounting flange and flexed to provide the clamping action.

7 Claims, 10 Drawing Figures

KNOCK-DOWN OPEN RISER STAIRWAY

The present invention relates to stairs, and more particularly, the present invention relates to stairway kits.

Knock-down spiral stairways are known. An example of such stairway which is sold by The Iron Shop of Broomall, Pa. comprises an upstanding pole and a series of tread segments mounted to the pole at different vertical levels and angular locations. Each tread segment has a collar fastened to the pole by set screws, and the treads are fastened together adjacent their outer ends to provide a rigid structure. A railing is customarily supplied with the other elements in kit form for installation by contractors, do-it-yourselfers, etc.

Although the aforementioned spiral stairway functions entirely satisfactorily, there is a demand for a sturdy straight stairway kit which is inexpensive to manufacture, aesthetically pleasing and capable of being assembled easily by the ultimate consumer.

With the foregoing in mind, a primary object of the present invention is to provide a novel open riser stair kit capable of being assembled readily at the installation site.

It is another object of the present invention to provide an improved knock-down open riser stairway which can be manufactured economically and which can be assembled by untrained people.

A further object of the present invention is to provide a unique knock-down stairway which can be assembled without requiring any special tools and which, therefore, is particularly well suited for installation by the typical do-it-yourselfer.

As a more specific object, the present invention provides a sturdy open riser stairway comprising an elongated tubular support member having a non-circular cross-section and adapted to be mounted in inclined relation between different levels in a structure to support step assemblies at various levels along its length. Each step assembly includes a mounting plate which engages the topside of the support member and to which is mounted a tread support having a horizontal load bearing portion and a reversely-turned downwardly-tapered strut portion. The mounting plate is clamped to the support member by a locking sleeve which engages the bottom and sides of the support member and which has outturned flanges bolted to lateral extensions on the mounting plate. In one embodiment, the bottom of the locking sleeve is slightly convex upwardly to provide a spring-like clamping action against the support member when the bolts are tightened and the bottom of the locking sleeve is flexed elastically. In another embodiment, the locking sleeve flanges are spaced from the mounting plate and flex slightly to provide the desired clamping action.

These and other objects, features, and advantages of the present invention should become apparent from the following description when taken in conjunction with the accompanying drawings, in which.

Figure 1:
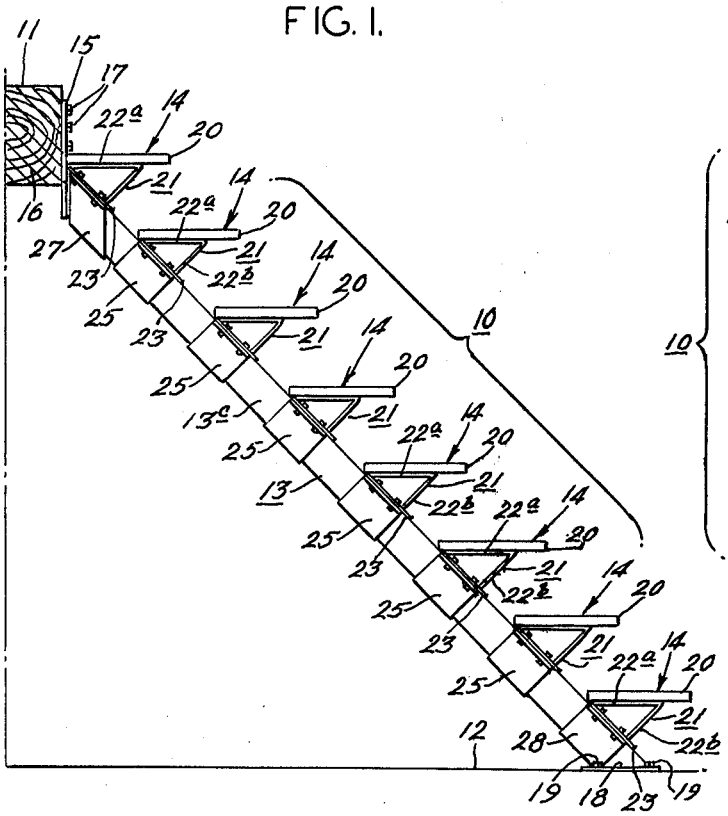
FIG. 1 is a side elevational view of an open riser stairway embodying the present invention.
Figure 2:
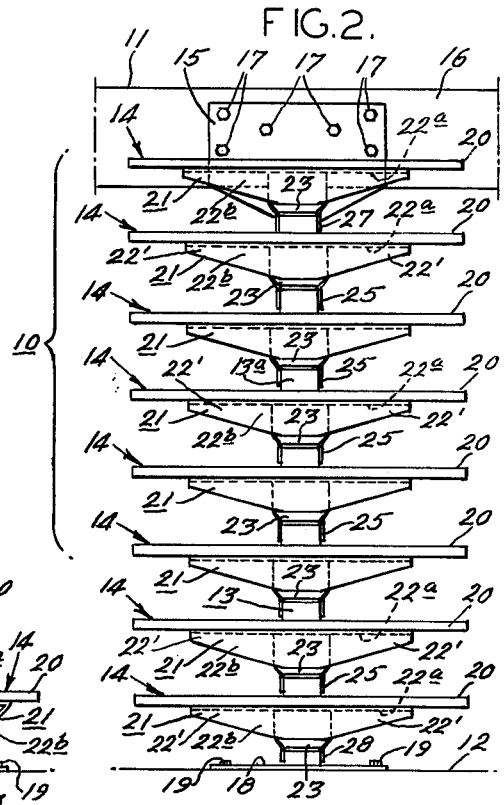
FIG. 2 is a front elevational view thereof.

Referring now to the drawings, FIGS. 1 and 2 illustrate a stairway 10 which embodies the present invention. As best seen in FIG. 1, the stairway 10 inclines between different levels in a structure, such as the upper level 11 and the lower level 12. Customarily, the stairway 10 is provided with a handrail; however, the handrail has been omitted from the drawings for better illustrating the important features of the present invention.

According to the present invention, the stairway 10 is designed to be shipped from the factory in knock-down or kit form for installation by the ultimate consumer, whether he be a building contractor, a homeowner or a do-it-yourselfer. As will become apparent, stairway 10 is designed to be assembled readily without any special tools and without any special training in the construction trades. Moreover, because of its simple design, the stairway can be erected in a minimum amount of time and with a minimum of labor.

To this end, the stairway 10 comprises an elongated, hollow main spar or support member 13 mounting a series of step assemblies 14, 14 at spaced intervals along its length. The upper or head end of the support member 13 is fastened to a header 16 at the upper level 11 by a series of lag screws or bolts 17, 17 which pass through pre-drilled holes in an upper mounting plate 15 welded at an acute angle across the upper end of the support member 13. The lower end of the support member 13 is anchored at the lower level 12 by lag screws or bolts 19, 19 which pass through a lower mounting plate 18 welded at an angle across the lower end or foot of the support member 13. Thus, the mounting plates 15 and 18 provide means at opposite ends of the support member 13 for mounting it securely in inclined relation between different levels in a structure.

Figure 5:
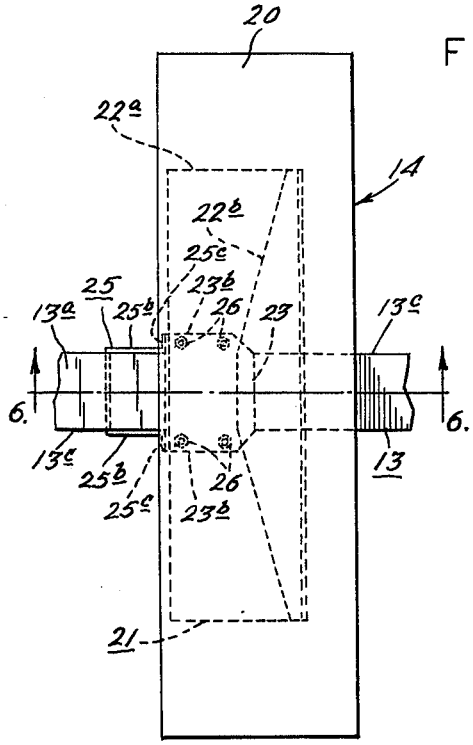
FIG. 5 is a plan view of one of the step assemblies, the view looking downward on line 5—5 of FIG. 3.

The step assemblies 14, 14 have generous tread areas and support relatively heavy loads safely. As best seen in FIGS. 2 and 5, the step assemblies extend horizontally outward in opposite directions from the support member 13 so that the support member 13 is located centrally under the step assemblies. Each step assembly 14 includes a tread 20, of wood or other rigid material, and a tread support 21 interposed between the tread 20 and the support member 13. In the illustrated embodiment, the tread 20 has a rectangular plan configuration and extends outwardly beyond the perimeter of the tread support 21 to provide a relatively large foot-support area.

Figure 8:
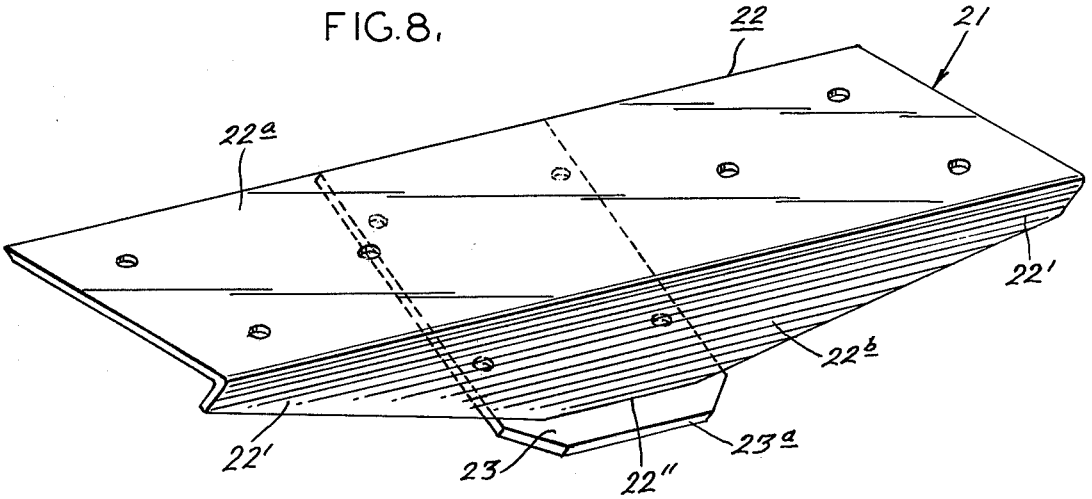
FIG. 8 is a perspective view of one of the tread support members.
Figure 9:
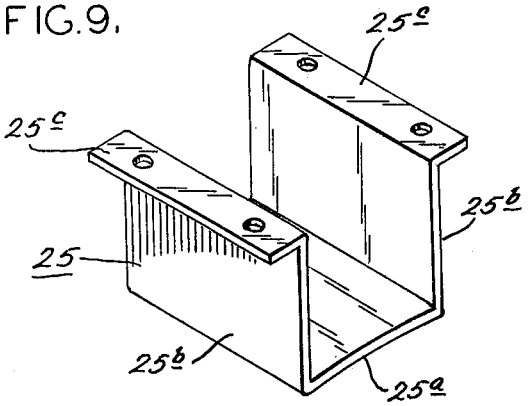
FIG. 9 is a perspective view of one of the locking sleeves.
Figure 10:
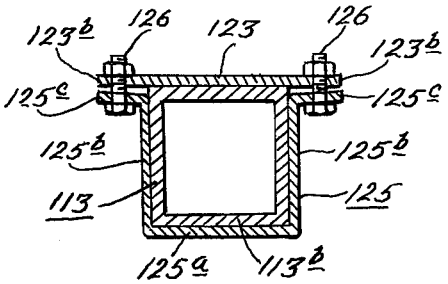
FIG. 10 is a sectional view similar to FIG. 7 but illustrating a modified locking sleeve.

The tread support 21 is relatively easy to manufacture. To this end, as best seen in FIG. 8, the tread support 21 includes a one-piece metal member 22 having a horizontal load-bearing portion **22*a* and a strut portion 22*b* both welded to an inclined mounting plate 23. The strut portion 22*b* is preferably bent rearwardly and downwardly from the front of the load-bearing portion 22*a*, and the strut portion 22*b* has edges 22′, 22′ which taper inwardly toward the mounting plate 23 from the outer ends of the load bearing portion 22*a*. The strut portion 22*b* has a lower edge 22″ welded to the mounting plate 23 a slight distance upwardly from its lower edge 23***a*, and the central portion of the rear edge of the load bearing portion 22*a* is also welded to the mounting plate 23. The tread 20 is fastened to the load bearing portion 22*a* by screws 24, 24 which pass upwardly through holes in the load bearing portion 22*a* and into the underside of the tread 20. The lengthwise bend in the metal member 22 along its front rigidifies the tread support 21 against downward bending when loads are applied eccentric to the mounting plate 23.

Figure 3:
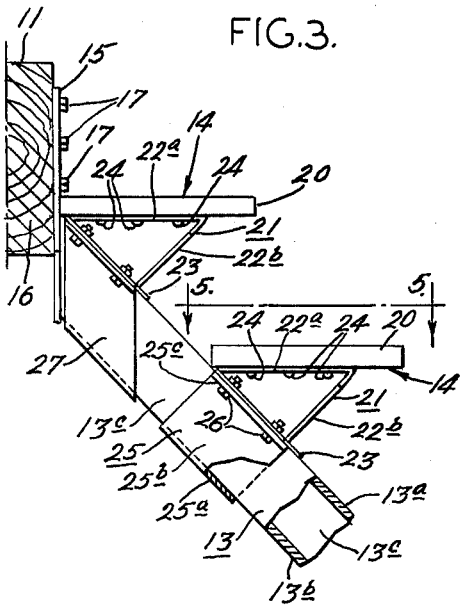
FIG. 3 is an enlarged fragmentary view with portions broken away of the head end of the stairway.
Figure 7:
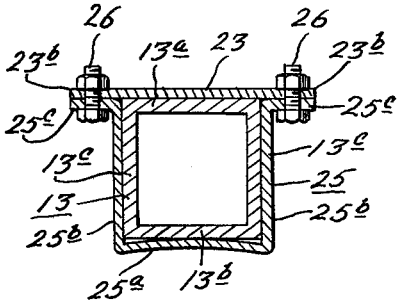
FIG. 7 is a sectional view taken on line 7—7 of FIG. 6.

The tread supports 21 can be mounted quickly onto the main support member 13. For this purpose, a locking sleeve 25 is provided for each tread support 21, and the tread support is bolted to its locking sleeve. In the present instance, the main support member 13 has a non-circular transverse cross section which is preferably square as illustrated in FIG. 7 and has top, bottom and opposed sidewalls 13*a*, 13*b* and 13*c*, 13*c*, respectively. The locking sleeve 25 has a complementary shape and embraces the bottom and sides of the support member and has a bottom web 25*a* engaging the bottom 13*b* of the support member and a pair of side webs 25*b*, 25*b* engaging the opposite sidewalls 13*c*, 13*c* of the main support member 13. The upper ends of the locking sleeve side webs 25*b*, 25*b* have outturned flanges 25*c*, 25*c* which extend laterally of the main support member 13 adjacent its top wall 13*a*. The mounting plate 23 has lateral extensions 23*b*, 23*b* which overlie the locking sleeve flanges 25*c*, 25*c*. The mounting sleeve flanges 25*c*, 25*c* are fastened to the mounting plate extensions 23*b*, 23*b* by bolts 26, 26. The top and bottom step assembly locking sleeves 27 and 28, respectively, (FIGS. 3 and 4) are basically the same as the locking sleeve 25, except to the extent that the locking sleeves 27 and 28 have been mitered to compensate for the presence of the mounting plates 15 and 18. Thus, the locking sleeves 25, 27 and 28 cooperate with the central support member 13 and the mounting plates 23 to prevent the treads 20, 20 from pivoting about the longitudinal axis of the support member 13 when loads are applied eccentric to the support member 13.

In order to ensure that the step assemblies resist sliding along the central support member 13, the bottom web 25*a* of the locking sleeve 25 is provided with a slight upward convexity between the side webs 25*b*, 25*b*. This causes the locking sleeve flanges 25*c*, 25*c* normally to be spaced a slight distance from the undersides of the mounting plate extensions 23*b* when the bolts are finger tightened. However, when the bolts 26, 26 are tightened by a wrench, the locking sleeve flanges 25*c* are drawn toward the mounting plate extensions 23*b* and the convex lower web 25*a* of the locking sleeve 25 flexes elastically and tends to straighten. As a result, when the bolts 26 are fully tightened, and the flanges and extensions engage one another, a strong clamping action is provided by the interaction of the mounting plate 23 and the locking sleeve 25 against the main support member 13. If desired, the clamping action may be provided by providing a modified locking sleeve 125 having a bottom wall 125*a* which engages flush against the bottom 113*b* of the support 113 and by dimensioning the side walls 125*b*, 125*b* in such a manner as to cause the outturned flanges 125*c*, 125*c* to flex upwardly when the bolts 126 are tightened. In this embodiment, a slight gap exists between each flange 125*c* and the mounting plate extension 123*b* even after the bolts 126 have been tightened.

Figure 6:
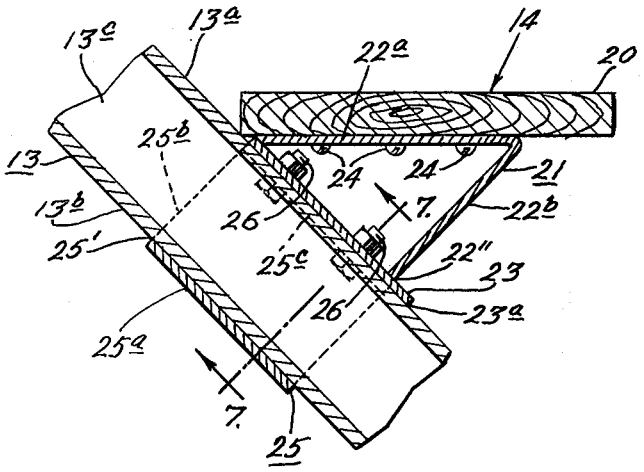
FIG. 6 is an enlarged sectional view taken on line 6—6 of FIG. 5.

The locking sleeve 25 and mounting plate 23 apply to the central support member a moment or couple about a horizontal axis to augment the aforementioned clamping action when the tread 20 is loaded. For this purpose, the locking sleeve webs 25*a* and 25*b* are dimensioned substantially as long as the length of the mounting plate 23 along the central support member 13. This causes the upper edge 25' of the locking sleeve web 25*c* (FIG. 6) to engage the bottom wall 13*b* of the support member 13 and causes the mounting plate edge 23*a* to engage the top wall 13*a* of the support member 13 at about the same horizontal level. Thus, when a downward load is applied toward the front of the tread 20, the horizontal spacing of the edges 25' and 23*a*, and their engagement with opposite sides of the central support member 13 provides a restraining moment which augments the clamping action provided by the locking sleeve to ensure a positive non-slip connection of the tread assembly 21 to the inclined central support 13.

Figure 4:
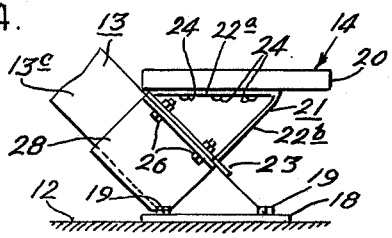
FIG. 4 is an enlarged fragmentary view of the foot end of the stairway.

To assemble the stairway 10, the mounting plates 15 and 18 are secured at their appropriate locations in a stairwell. The bottom tread 20 and tread support 21 are then placed on the central support member 13, and the lower locking sleeve 28 is applied as indicated in FIG. 4. The bolts 26, 26 are then passed through the aligned holes in the locking sleeve flanges and the mounting plate extensions, and the bolts are tightened. The rest of the step assemblies are similarly mounted; however, the bolts 26, 26 are preferably only finger-tightened until all of the step assemblies have been mounted. This facilitates accurate spacing, since the step assemblies 14, 14 can be slid along the support member 13 into the desired locations before the bolts are tightened by a wrench.

In view of the foregoing, it should be apparent that the present invention now provides a knock-down stairway which is capable of being shipped direct from the factory to the consumer for erection expeditiously by the consumer without requiring any special tools or special training.

While a preferred embodiment of the present invention has been described in detail, various modifications, alterations and changes may be made without departing from the spirit and scope of the present invention as defined in the appended claims.

We claim:

1. A stairway, comprising:

an elongated main support member having a non-circular transverse cross section with top, bottom and side walls;

means carried at opposite ends of said support member for mounting said support member in inclined relation between different levels of a structure;

a plurality of independent step assemblies extending laterally from both sides of said main support member carried in spaced relation on said support member;

each step assembly including:

a tread support having a mounting flange engaging the top of said support member, a locking sleeve having a bottom web and side webs engaging respectively the bottom and side walls of said support member, and means fastening said locking sleeve to said tread support mounting flange to provide a clamping action on the support member, whereby the step assemblies are securely fastened to the support member.

2. The stairway according to claim 1 wherein said tread support mounting flange has extensions extending laterally beyond the sidewalls of the support member, the locking sleeve has a pair of outturned flanges disposed adjacent said mounting flange extensions, and said fastening means include bolts connecting said locking sleeve flanges to said tread support mounting flange extensions.

3. The stairway according to claim 1 wherein the bottom web of the locking sleeve is convex between the side webs thereof for flexing elastically relative to the bottom of the support member upon tightening of said fastening means to maintain clamping pressure on the support member.

4. The stairway according to claim 1 wherein said tread support includes a mounting plate and a one-piece member fastened to said mounting plate, said one-piece member having an elongated load bearing portion overlying said mounting plate and an inwardly-tapered strut portion depending from the front of the load-bearing portion at an angle with respect thereto.

5. The stairway according to claim 1 wherein said main support member has a rectangular cross-section and said locking sleeve and mounting flange define a complementary cross-section for resisting torquing of each step assembly about the longitudinal axis of the support member when an eccentric load is applied on the step assembly.

6. The stairway according to claim 1 wherein said locking sleeve has an upper edge extending across the underside of the support member, and the mounting flange has a lower edge extending across the topside of the support member at about the same horizontal level as the locking sleeve edge for cooperating therewith to provide a firm grip on the support member when a load is applied toward the front of the tread support.

7. The stairway according to claim 1 wherein said bottom web of said locking sleeve engages flush against the bottom of the support member and said side webs of said locking sleeve are dimensioned relative to said support member to enable said locking sleeve flanges to flex upwardly toward the mounting plate upon tightening of said fastening means.

* * * * *